United States Patent [19]

Kim

[11] Patent Number: 5,029,257

[45] Date of Patent: Jul. 2, 1991

[54] METHOD FOR SEPARATING SCAN LINE DRIVE IN PLASMA DISPLAY PANEL AND CIRCUIT ARRANGEMENT THEREOF

[75] Inventor: Jung-Hea Kim, Seoul, Rep. of Korea

[73] Assignee: Samsung Electron Device Co., Ltd., Kyonggi, Rep. of Korea

[21] Appl. No.: 400,994

[22] Filed: Aug. 31, 1989

[30] Foreign Application Priority Data

Mar. 31, 1989 [KR] Rep. of Korea ..... 89-4265

[51] Int. Cl.[5] ..... G09G 3/10; G09G 3/22

[52] U.S. Cl. ..... 315/169.4; 340/771; 340/773

[58] Field of Search ..... 315/169.4, 169.1, 169.2, 315/169.3; 340/773, 771, 774, 776, 777, 772, 778, 805, 811; 313/582, 581, 500

[56] References Cited

U.S. PATENT DOCUMENTS 4,366,504 12/1982 Kanatani ..... 358/241

4,859,910 8/1989 Iwakawa et al. ..... 315/169.1

*Primary Examiner*—Eugene R. LaRoche

*Assistant Examiner*—Ali Neyzari

*Attorney, Agent, or Firm*—Flynn, Thiel, Boutell & Tanis

[57] ABSTRACT

A method and circuit for driving scan line in plasma panel is disclosed for dividing scan line of n-numbered cathode in two such that left side of scan line is constructed as a first group of even numbered cathode, and right side of scan line is as a second group of odd numbered cathode. There is provided a separate cathode driver and signal generation and processing portion with both first and second group of cathode. One picture of plasma panel is driven with two fields in an interlacing manner in that the conventional scanning frequency of 60 Hz is divided in two.

2 Claims, 3 Drawing Sheets

METHOD FOR SEPARATING SCAN LINE DRIVE IN PLASMA DISPLAY PANEL AND CIRCUIT ARRANGEMENT THEREOF

BACKGROUND OF THE INVENTION

1. Field of the invention

The present invention relates generally to plasma display panel and more particularly to a method and a circuit arrangement for separating scan line drive such that the scan line is divided into left part and right part and sequentially driven to improve the resolution of the plasma display panel.

2. Description of the prior art

In general, a plasma display panel is comprised of small neon gas discharge tubes arranged most popularly in a 512×512 matrix and provides a much brighter picture than the conventional display tube. In such a plasma display panel, the scanning of plasma display panel is carried out sequentially from the first line to the last line of the picture, and thus the only circuit means including logical and drive unit is necessary for controlling scan line drive.

While there is no problem in use of the above-mentioned plasma display panel in case of the size of screen is relatively small, however, as the size of screen grew larger and as the resolution of picture grew higher, it has been exposed following problem.

In a larger screen, the number of dot or pixel of picture has increased and the number of cathode electrode in plasma display panel should be increased as well. Driving of great number of electrodes requires a high speed operation of high scanning frequency, and this will cause flicker phenomena in discharge and deteriorate picture quality. Also, large screen of plasma display panel makes its duty factor small which reduces light ON period of each dot and consequently this will deteriorate the picture quality.

Japanese Patent publication SHO Nos. 58-124523, 58-195812 and 58-195813 disclosed a display panel driving means which have characteristic features of high speed operation and low power consumption. In these patents, when the plasma display panel is driven sequentially, as drivers for row and column designation connected respectively to data line and scan line are comprised of push-pull driver, it can be shared refresh driving mean with column designation driving means as for scan line. These drivers provide simple circuit configuration and offer convenience to make an integrated circuits.

Also, there is disclosed in U.S. Pat. No. 4,366,504 an matrix type picture display panel comprised of a plurality of data line and scan line which are arranged in row and column and luminance cell is disposed at the respective cross point thereof. This prior art is so called precharge type line sequence drive method that is driven commonly by way of precharge in driving matrix of electro-luminescent panel. Thus, such a method give rise to increse of power consumption and to limitation of frame frequency by required precharge driving time. Accordingly, the above-mentioned method has disadvantage that it is not suitable especially for high speed scanning.

For easy reference, there is shown a block diagram which depict the overall construction of a module of plasma display panel in FIG. 1. In FIG. 1, numeral 10 is designated central processing unit (CPU) of main system, which receives data signal that is signal source generated from personal computer or laptop computer, horizontal/vertical sync. signal, clock signal, enable signal, etc. and produces control signal for driving plasma display panel. The data signal $D_0 \sim D_n$ of CPU 10 is supplied to anode driver 80 of display panel 90 via data buffer 20. Also, brightness signal Y generated in CPU 10 is supplied to anode driver 80 via brightness controller 30, and horizontal/vertical sync. signal SYNC from CPU 10 is supplied to clock generator 40 for panel, and the clock signal CLOCK from CPU 10 is supplied to anode timing generator 60.

Besides, clock generator 40 for display panel is connected such that it controls brightness controller 30, and controls vertical syncronization signal of anode timing generator 60 to drive anode driver 80. Also, clock generator 40 is connected such that it controls horizontal sync. signal of cathode timing generator 50 to drive cathode driver 70. Thus, in this circuit, the anode driver 80 drives vertical line of display panel 90 according to vertical sync. of display panel 90 and the cathode driver 70 drives horizontal line of display panel 90 according to horizontal sync. of the panel 90.

In this arrangement, the conventional method of sequential scanning is, as shown in FIG. 2, such that cathode timing generator 50 which receives control signal from clock generator 40 generates control signals for controlling left side and right side cathode driver 71 and 72 as well as clock signal K-CLK for left and right side cathode dirver 71 and Further, both left and right side cathode driver 71, 72 are comprised of shift registors and connected to display panel 90 through each of switching transistors.

The operation of the circuit of FIG. 2 is appeared in timing diagram of FIG. 3. In FIG. 3, the cathode clock signal (a) generated from cathode timing generator 50 is applied to both left and right side cathode drivers 71, 72. At this time, signal (b) for left side cathode driver 71 is applied to the first line $X_0$ of display panel 90 through the first switching transistor to initiate scanning. Subsequently, signal (c) for right side cathode driver 72 is applied to the second line $X_1$ of display panel 90 through the driver 72 and the first switching transistor.

As mentioned above, the control signal is supplied sequentially from cathode timing generator 50 to both left and right side cathode drivers 71, 72 and thus display panel 90 undergoes sequential scanning.

On the other hand, refering to the timing diagram FIG. 3, at one half of the applied frequency both left and right cathode driver 71, 72 will operate, however, the enable time for substantial scanning operation is period to. Thus, as the scan enable time is reduced to one half of real operating frequency, the brightness of display panel is not sufficient in respect of real operating frequency.

SUMMARY OF THE INVENTION

Accordingly, it is the object of the present invention to solve the problem of aforementioned prior art and to provide a method of separating scan line drive into left and right side each of which are provided with separate scanning frequency generator and for driving one picture with two fields by interlacing manner such that conventional scanning frequency of 60 Hz is divided in two.

According to the present invention, there is provided a circuit for driving scan line of plasma display panel, comprising: a counter unit arranged to count n-numbered line of cathode with cathode clock signal, in which counting of line is divided into the first n/2 line and the rest n/2 line that is for even numbered line and odd numbered line, a flip-flop for producing positive signal and negative signal according to output of said counter unit, a left cathode signal generation and processing unit driven in response to said positive signal output, and a right cathode signal generation and processing unit driver in response to said negative signal output.

DETAILED DESCRIPTION OF THE INVENTION

Figure 1:
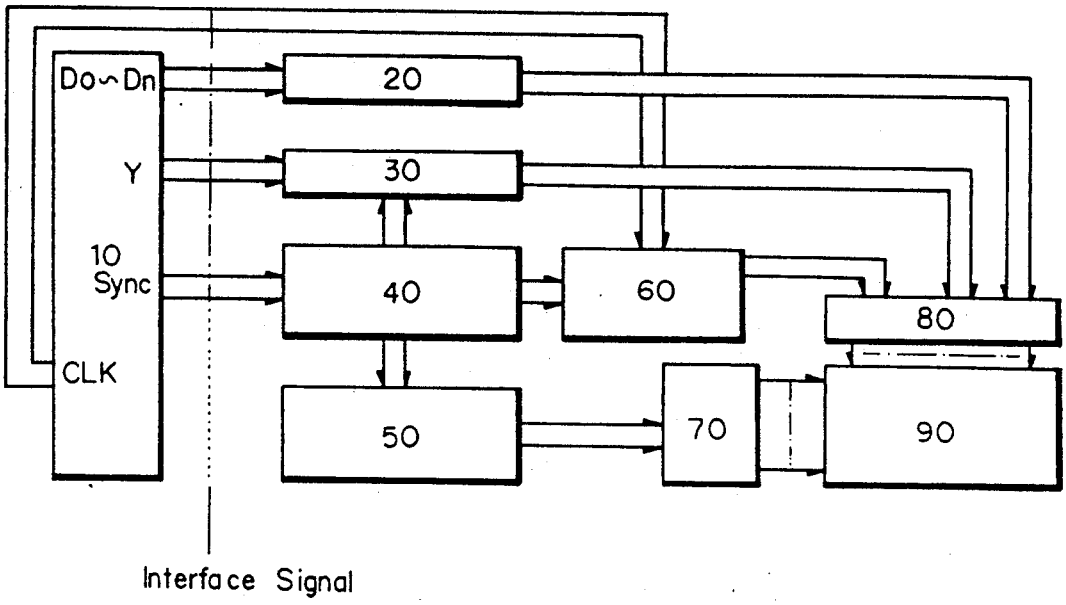
FIG. 1 PRIOR ART
FIG. 1 shows block diagram of plasma display panel module.
Figure 2:
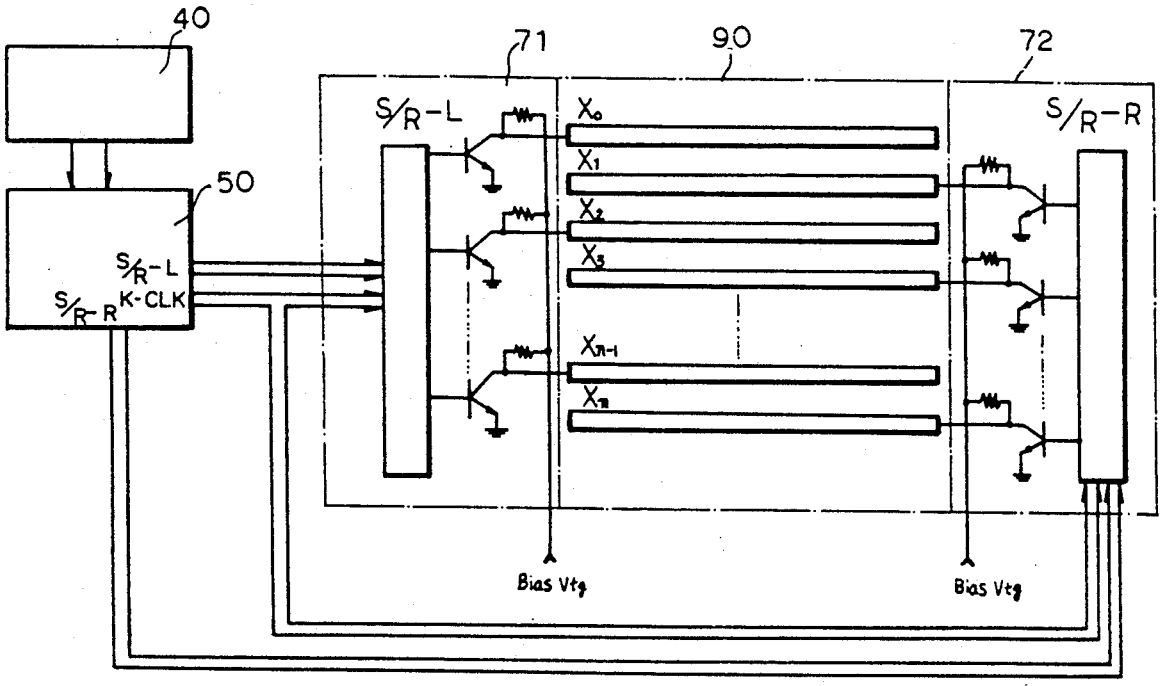
FIG. 2 PRIOR ART
FIG. 2 is a block diagram for illustrating the conventional sequential scanning method.
Figure 3:
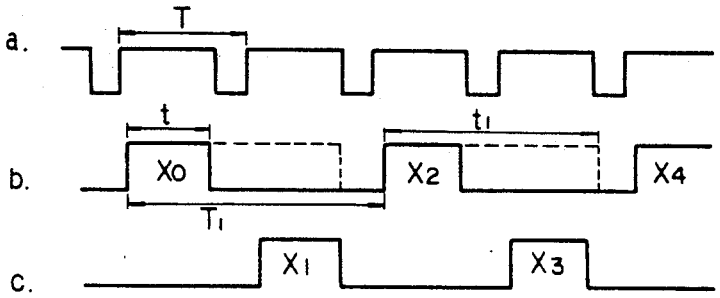
FIG. 3 PRIOR ART
FIG. 3 is an output waveform according to the conventional sequential scanning method.
Figure 4:
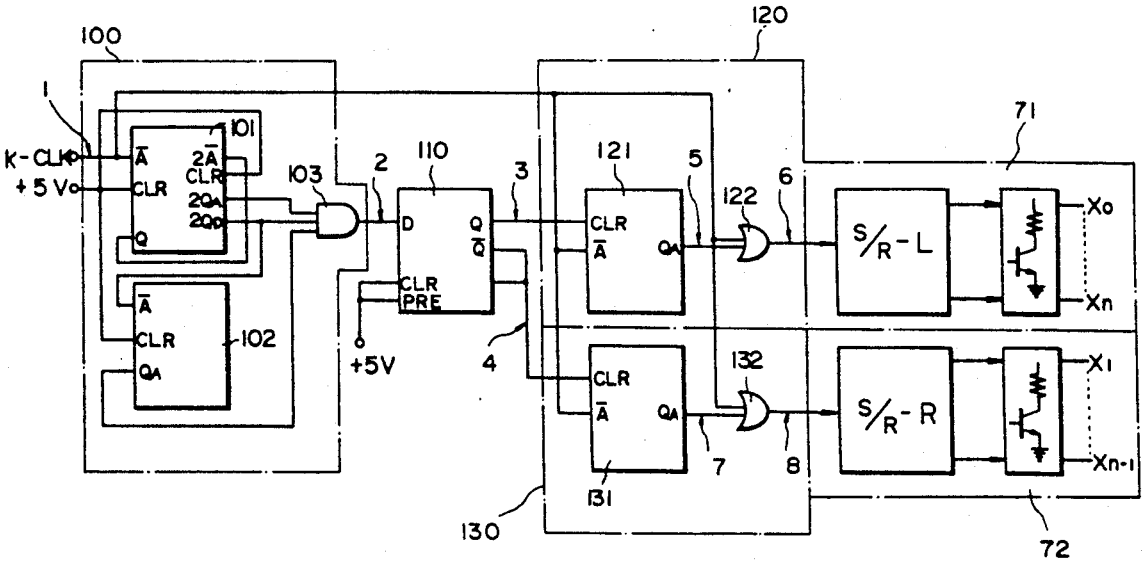
FIG. 4 is a block diagram of a circuit of the plasma display panel cathode driver and illustrating interlace scanning method according to the invention.

FIG. 4 shows a block diagram of a circuit comprising the plasma display panel cathode driver according to the invention. The circuit includes counter portion 100 which receives the cathode clock signal K-CLK from aforementioned cathode timing generator 50 and consists of two counters 101, 102 and a AND gate 103. The line of cathode clock signal K-CLK is connected with input $\overline{A}$ of a first counter 101, and its output $2Q_A$, $2Q_D$ are connected to one input of AND gate 103, also the output $2Q_D$ is connected to input $\overline{A}$ of a second counter 102.

The output $Q_A$ of a second counter 102 is connected with another input of AND gate 103. And clear terminals CLR of said counters 101, 102 are provided with supply voltage (+5V).

The output of said counter portion 100, i.e. output of AND gate 103 is connected to input D of D-Flip Flop 110, whose clear input CLR and preset input PRE are supplied with the supply voltage, and positive output Q and negative output $\overline{Q}$ of D-flip flop 110 are connected with each clear input CLR of counters 121 and 131 respectively, which are left and right signal generation and processing portions 120 and 130. Each input $\overline{A}$ of the counters is connected to K-CLK, and this clock signal K-CLK is supplied to OR gates 122 and 132, and whose other inputs are connected with outputs $Q_A$ of each counter 121, 131. Further, the output of OR gate 122 is connected with left side cathode driver 71 and output of OR gate 132 is connected with right side cathode driver 72.

With this circuit arrangement, operation and effect of the present invention will be described with reference to FIG. 4 and FIG. 5.

Figure 5:
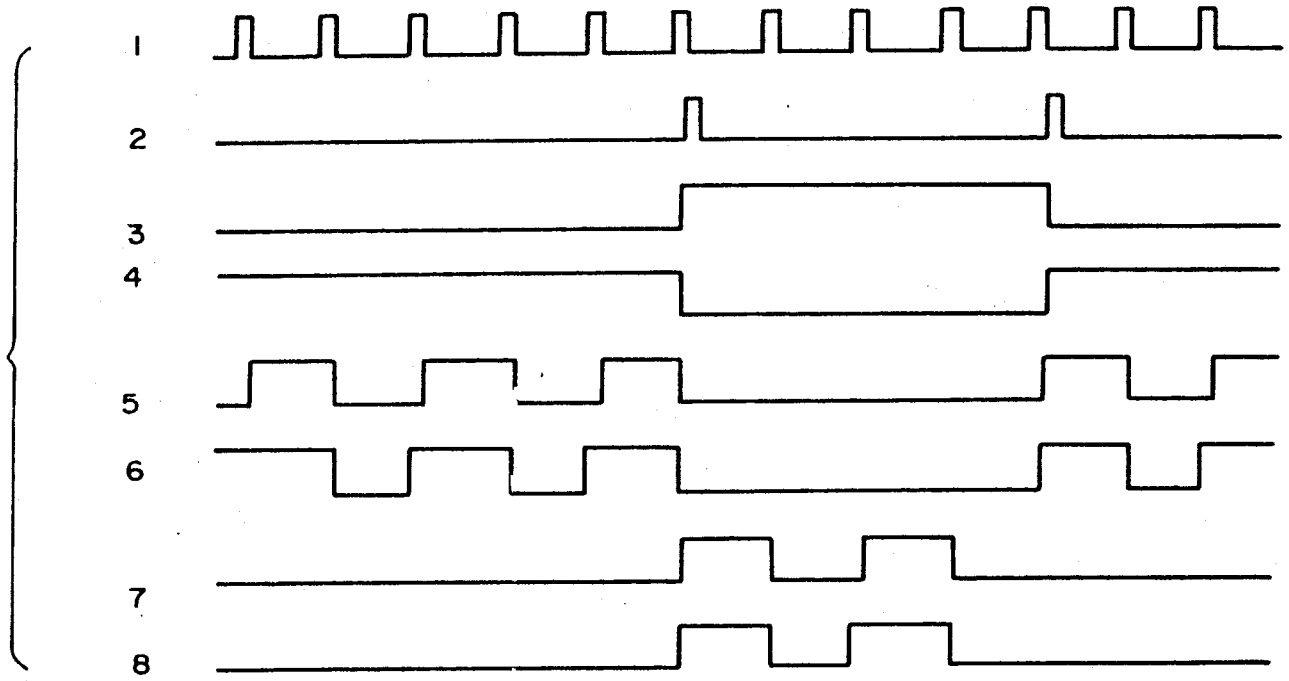
FIG. 5 is an output waveform according to the interlace scanning method of the invention.

Counter portion 100 is supplied with a cathode clock signal K-CLK as signal 1 shown in FIG. 5 from said cathode timing generator 50, and counts the horizontal 400 lines of cathode electrode. This counter portion 100 is cleared initially by supply voltage of 5 V and by completion of counting the 400 horizontal lines. Counting signals $2Q_A$, $2Q_D$ outputted from a first counter 101 are supplied to two inputs of AND gate 103, while the counting signal $2Q_D$ is supplied to a second counter 102 to initiate counting, and after completion of counting of 400 lines, the output signal $Q_A$ of second counter 102 is applied to the other input of AND gate 103.

The output signal of AND gate 103 is shown in waveform 2 of FIG. 5, this output signal 2 is applied to D input of D-Flip Flop 110, and whose positive output signal Q becomes as waveform 3 of FIG. 5. At this time, a high level signal will drive counter 121 of the left signal generation and processing portion 120. Thus, the output signal $Q_A$ of counter 121 will be the same as waveform 5. The output signal 5 of said counter 121 is supplied to OR gate 122 with cathode clock signal K-CLK, and the waveform of output signal of said OR gate 122 becomes as 6 in FIG. 5 and it drives left side cathode driver 71. Subsequently, driving of the left side cathode is completed, D-Flip Flop 110 is provided with a signal from counter portion 100 and it produces negative output signal $\overline{Q}$ as shown in waveform 4. Then, the output signal 4 is applied to said counter 131 of the right side signal generation and processing portion 130 and the output Q of said counter 131 will be like waveform 7 of FIG. 5.

The output signal 7 is applied to OR gate 132 along with cathode clock signal K-CLK, and produces an output signal same as waveform of 8. The output signal 8 will drive the right side driver 72 of cathode. By completion of driving the left side cathode driver, it is followed by the driving of the right side cathode driver in an interlacing manner, thus the whole cathode unit can be driven accordingly.

In describing the above-mentioned interlace scanning operation as for the picture field, firstly it constructs the first field by sequentially scanning cathode electrode unit connected to a first group of drivers, and it is followed by scanning cathode electrode unit connected to a second group of drivers, thus the second field is constructed. And thus, it is possible to construct one picture with two fields.

Whereas the present invention has been defined in terms of a simplified illustrative example utilizing a somewhat generalized block diagram presentation, it is contemplated that alterations and modifications of the system as well as the various interrelationships of the illustrated components will become apparent to those skilled in the art after having read the foregoing disclosure. Accordingly, it is to be understood that the particular apparatus described is for purposes of illustration only and the appended claims are to be interpreted as covering all modifications and alterations that fall within the true spirit and scope of the invention.

What is claimed is:

1. A circuit for driving scan lines of a plasma display panel, comprising;

a counter portion arranged to count n-numbered lines of cathode with a cathode clock signal, in which counting of said lines is divided into a first group of n/2 lines and the remaining n/2 lines, that is, even numbered lines and odd numbered lines, a flip-flop for producing a positive signal and a negative signal according to an output of said counter unit, a left cathode signal generation and processing portion driven in response to said positive signal output, and a right cathode signal generation and processing portion driven in response to said negative signal output.

2. A method of driving scan lines in a plasma display panel, comprising;

dividing scan lines of n-numbered cathodes in two such that one side is to be constructed as a first group of even numbered cathodes, and another side is to be constructed as a second group of odd numbered cathodes, providing a separated cathode driver and signal generation and processing unit for each said first and said second group, and driving two fields separately such that one picture is controlled by said two fields and scanned in an interlacing manner.

* * * * *